US009995465B2

(12) United States Patent
Chen

(10) Patent No.: US 9,995,465 B2
(45) Date of Patent: Jun. 12, 2018

(54) SURFACE-MOUNTED PLUGGABLE WIRING INSERT KEY, DRIVING POWER SOURCE BOX, AND DETACHABLE MODULAR LED LAMP

(71) Applicant: Guangyou Chen, Bengbu (CN)

(72) Inventor: Guangyou Chen, Bengbu (CN)

( * ) Notice: Subject to any disclaimer, the term of this patent is extended or adjusted under 35 U.S.C. 154(b) by 0 days. days.

(21) Appl. No.: 15/563,563

(22) PCT Filed: Mar. 27, 2016

(86) PCT No.: PCT/CN2016/077459

§ 371 (c)(1),
(2) Date: Sep. 30, 2017

(87) PCT Pub. No.: WO2016/155584

PCT Pub. Date: Oct. 6, 2016

(65) Prior Publication Data

US 2018/0087749 A1 Mar. 29, 2018

(30) Foreign Application Priority Data

Mar. 31, 2015 (CN) ..... 2015 1 0147229

(51) Int. Cl.
*F21V 29/00* (2015.01)
*F21V 15/01* (2006.01)
(Continued)

(52) U.S. Cl.
CPC ..... *F21V 15/01* (2013.01); *F21V 15/04* (2013.01); *F21V 19/001* (2013.01); *F21V 23/06* (2013.01); *H01R 4/4836* (2013.01)

(58) Field of Classification Search
CPC ..... H01R 4/48; H01R 4/4818; H01R 4/4836; H01R 4/4845; H01R 12/515; H01R 12/57; H01R 12/7088; H01R 13/11; F21V 23/06
See application file for complete search history.

(56) References Cited

U.S. PATENT DOCUMENTS 6,682,364 B2 * 1/2004 Cisey ..... H01R 9/2666 439/441
2011/0250775 A1 * 10/2011 Bies ..... H01R 4/4836 439/296

(Continued)

FOREIGN PATENT DOCUMENTS

CN 201018017 Y 2/2008
CN 201097399 Y 8/2008

(Continued)

*Primary Examiner* — Alexander Garlen
(74) *Attorney, Agent, or Firm* — Gokalp Bayramoglu

(57) ABSTRACT

A surface-mounted pluggable wiring insert key capable of being used for connecting structural parts of multiple strands of weak-current flexible wires, a driving power source box formed by using the surface-mounted pluggable wiring insert key, and a detachable modular LED lamp provided with the driving power source box structure. A damaged driving power source and other damaged assemblies can be conveniently replaced, abandonment of an LED chip having a long service life or even a whole LED lamp can be prevented, the designed structure is simple, and tin soldering is not required, thereby saving resources, greatly reducing use cost, and facilitating the popularization of the LED lamp.

15 Claims, 8 Drawing Sheets

(51) Int. Cl.

| | |
|---|---|
| ***F21V 15/04*** | (2006.01) |
| ***F21V 19/00*** | (2006.01) |
| ***F21V 23/06*** | (2006.01) |
| ***H01R 4/48*** | (2006.01) |

(56) References Cited

U.S. PATENT DOCUMENTS

2014/0029258 A1* 1/2014 Schroll ..... F21V 29/507 362/249.02
2014/0242833 A1* 8/2014 Mostoller ..... H01R 4/4836 439/438
2014/0268887 A1* 9/2014 Schroll ..... F21V 29/507 362/652
2014/0308855 A1* 10/2014 Gassauer ..... H01R 4/4836 439/682
2015/0325929 A1* 11/2015 Okura ..... F21V 23/002 439/444
2015/0357728 A1* 12/2015 Chen ..... H01R 4/48 439/725

FOREIGN PATENT DOCUMENTS

| | | | |
|---|---|---|---|
| CN | 201964217 | U | 9/2011 |
| CN | 102237608 | A | 11/2011 |
| CN | 202177069 | U | 3/2012 |
| CN | 102853302 | A | 1/2013 |
| CN | 102878463 | A | 1/2013 |
| CN | 203240424 | U | 10/2013 |
| CN | 103470991 | A | 12/2013 |
| CN | 203442654 | U | 2/2014 |
| CN | 104696921 | A | 6/2015 |
| CN | 204513301 | U | 7/2015 |
| WO | WO2014073945 | A1 | 5/2014 |

* cited by examiner

SURFACE-MOUNTED PLUGGABLE WIRING INSERT KEY, DRIVING POWER SOURCE BOX, AND DETACHABLE MODULAR LED LAMP

CROSS REFERENCE TO RELATED APPLICATION

This application is the national phase entry of International Application No. PCT/CN2016/077459, filed on Mar. 27, 2016, which is based upon and claims priority to Chinese Patent Application No. 201510147229.2, filed on Mar. 31, 2015, the entire contents of which are incorporated herein by reference.

TECHNICAL FIELD

The present invention relates to a surface-mounted pluggable wiring insert key, a driving power supply box, and a detachable modular LED light.

BACKGROUND

With the rapid development of LED lighting technology, the energy-saving effect of LED light has reached a very high level. In the case of the same illumination effect, the energy consumption of LED light has dropped to ⅛ of the energy consumption of incandescent lights and ½ of the energy consumption of electronic energy-saving lights. LED illumination products have gradually replaced the current traditional illumination products.

The cost of a LED light mainly depends on the cost of the heat-dissipating light cover and driving power supply. Regarding the quality of a LED light, the most important factors are the heat dissipation, LED light beads, and driving power supply. LED driving power supply is a voltage converter that converts the power supply to a specific voltage and current to drive the LED to illuminate. In most cases, the output of the LED driving power supply is a constant current source in which the voltage varies according to the change of the forward voltage drop of the LED. It is the capacitor that affects the overall life of the driving power supply. The lifespan of the capacitor at high temperature directly affects the lifespan of the driving power supply, thereby affecting the lifespan of the entire LED light.

For the LED without a heat sink or with poor heat dissipating effect, the central temperature may reach up to 110 degrees or more, resulting in a significant reduction in lifespan of the capacitor, thereby reducing the overall lifespan of the driving power supply. The standard lifespan of an LED light is that the lamp will be deemed as faulty when the light attenuation is 30%. That is, when the light is attenuated to 70% of the initial state, this light is considered as out of order. In normal circumstances, a 3 W bulb normally has a lifespan of 25,000 hours or so. When the product is designed, the lifespan of the driving power supply should match the lifespan of the LED chip (or LED light beads) as much as possible, so as to prolong the lifespan of the LED light. However, the lifespan of the driving power supply is limited by the capacitor with a short lifespan, resulting in a large gap between the long lifespan of the current LED chip and the short lifespan of the driving power supply. Since the current LED light uses the internal structure where the power supply is fixedly connected to the LED light. That is, the positive and negative poles of the driving power supply are connected to the LED light beads and the light head.

Thus, the driving power supply is not detachable. As a result, the long-lifespan LED chip and even the whole LED light has to be abandoned due to the short lifespan of the driving power supply, causing a great waste of resources. Moreover, the high cost in terms of production and usage is harmful to the popularity of the LED lights.

SUMMARY OF THE INVENTION

It is an object of the present invention to provide a surface-mounted pluggable wiring insert key which can be used for a small-sized flexible cable electrical connection structure, a driving power supply box formed by the surface-mounted pluggable wiring insert key, and a detachable modular LED light comprising the driving power supply box.

The present invention can realize the convenient replacement of the driving power supply and other components, saving the energy resources, greatly reducing the use cost. Also, the present invention is advantageous to the popularization of the LED lights.

The surface-mounted pluggable wiring insert key of the present invention comprises an insert key box, and a positive pole insert key body and a negative pole insert key body that are mounted in the insert key box. Each of the positive pole insert key body and the negative pole insert key body comprises an insert plate and each of the two ends of each insert plate is provided with two elastic insert pieces. Two elastic insert pieces on each end of the insert plates are curled inwardly such that one end of each of the two elastic insert pieces forms a wire clamp and the other end of each of the two elastic insert pieces form a wiring slot. Each end of the insert key box is provided with a wiring hole that corresponds to a position of the wiring slot. An upper part of the insert key box is provided with a press key, which is located right above the wire clamp. The positive pole insert key body, the negative pole insert key body, and the elastic insert piece are conductors, while the insert key box is an insulator.

For the surface-mounted pluggable wiring insert key, in the positive pole insert key body and the negative pole insert key body, two wire clamps formed on two ends of the insert plate are positioned oppositely.

For the surface-mounted pluggable wiring insert key, in the positive pole insert key body and the negative pole insert key body, a center part of the insert plate protrudes upwardly to be close to the wire clamp.

The LED driving power supply box of the present invention comprises a light head. The light head is provided with a power supply bracket mounting plate. An upper surface of the power supply bracket mounting plate is provided with at least two abovementioned surface-mounted pluggable wiring insert keys. A power supply cover is located below and connected to the power supply bracket mounting plate. A space for accommodating a driving power supply is formed between the power supply bracket mounting plate and the power supply cover. The power supply bracket mounting plate is provided with a threaded hole. A positive pole leading wire and a negative pole leading wire of the driving power supply pass through the threaded hole and connect to the surface-mounted pluggable wiring insert key and in turn connect to the positive and negative poles of the light head and the positive and negative poles of the light bead.

For the LED driving power supply box, the upper surface of the power supply bracket mounting plate is provided with a groove rail. An insert key box of the surface-mounted pluggable wiring insert key is provided with a connecting part fitting the groove rail such that the surface-mounted pluggable wiring insert key is movably mounted on the upper surface of the power supply bracket mounting plate.

For the LED driving power supply box, an end portion of each side of the power supply bracket mounting plate is provided with a ledge, each side portion of the power supply cover is provided with a linear groove fitting the ledge such that the power supply cover is movably mounted on the power supply bracket mounting plate.

For the LED driving power supply box, the power supply cover is provided with a ventilation hole.

The detachable modular LED light of the present invention comprises a LED light source, a driving power supply, and a heat-dissipating light housing. The detachable modular LED light further comprises the abovementioned driving power supply box. The LED driving power supply box can be mounted in the heat dissipating light housing and the heat dissipating light housing is detachably connected to the LED driving power supply box. The LED driving power supply box can be connected to the heat dissipating light housing through a threaded connection, a snap-fit connection, an elastic-pin connection, or other connecting manners to achieve the detachable connection.

For the detachable modular LED light, the heat-dissipating light housing has an overall shape that is necked down from top to bottom. Several ventilation holes are positioned from top to bottom between an inner wall and an outer wall of the heat-dissipating light housing. The inner wall is higher than the outer wall at an upper end of the heat-dissipating light housing.

For the detachable modular LED light, the LED light source is located in a cylindrical light cover, and the cylindrical light cover is detachably connected to a lower end of the heat-dissipating light housing. The cylindrical light cover can be connected to the heat dissipating light housing through a threaded connection, a snap-fit connection, an elastic-pin connection, or other connecting manners to achieve the detachable connection. The detachable modular LED light of the present invention is suitable for LED bulb light, tube light, and spotlight.

The present invention provides a surface-mounted pluggable wiring insert key that can be used in multi-strand flexible wire connection structure, a driving power supply box formed by the surface-mounted pluggable wiring insert key, and a detachable modular LED light comprising the driving power supply box. The present invention can realize the convenient replacement of damaged driving power supply and the related parts without causing the abandonment of the LED chip with long lifespan or even the whole LED light. In addition, the present invention has a simple structure and a low manufacturing cost, which eliminates the requirement of welding, saves resources, reduces the use cost and production cost. Also, the present invention is conducive to the popularity of LED lights.

The advantages of the present invention are mainly shown in the following aspects.

(1) The heat dissipating light cover uses the hot and cold air convection principle to independently dissipate heat through the ventilation holes necking down from top to bottom such that the electrical components in the light cover can be protected from dust or any other affect. The outer layer of the heat dissipating light cover can also be wrapped by heat dissipating plastic, resulting in a more secure and aesthetic lighting body.

(2) Compared with the conventional hemispherical light cover, the cylindrical light cover of the present invention can have its light transmission angle increased to more than 270 degrees. Concave surface can be applied to the top of the light cover to make the light spread and illuminate a long distance.

(3) The power supply bracket mounting plate is provided with ledges, grooves, and threaded holes and can receive the surface-mounted pluggable wiring insert key and the driving power supply, such that the surface-mounted pluggable wiring insert key and driving power supply can be installed more conveniently and flexibly.

(4) The power supply cover can protect the driving power supply from short circuit and electricity leakage due to the contact of the driving power supply with the heat dissipating light housing. Thus, the light is secure and complies with the safety requirements all over the world.

(5) The surface-mounted pluggable wiring insert key of the present invention can be used as a surface-mounted welding insert part or a pluggable insert part. The power supply and light source can be detached conveniently and flexibly.

(6) With the structure of the present invention, only the damaged components need to be replaced, and there is no need to scrap the whole light. This is good for the environment. There is no need to use low-level material that will lower the performance of the light. Therefore, the quality of the light is improved and the use cost of LED light is significantly reduced. Thus, the popularization of the LED light can be achieved faster and better.

Figure 1:
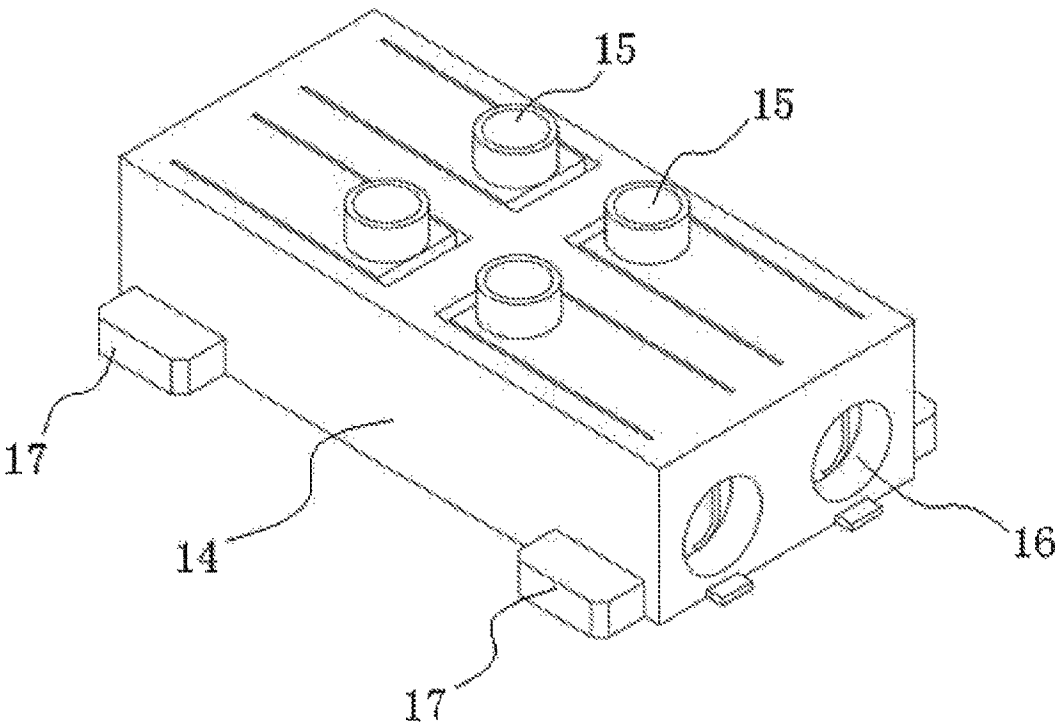
FIG. 1 is the structural schematic view of the surface-mounted pluggable wiring insert key according to the present invention.
Figure 2:
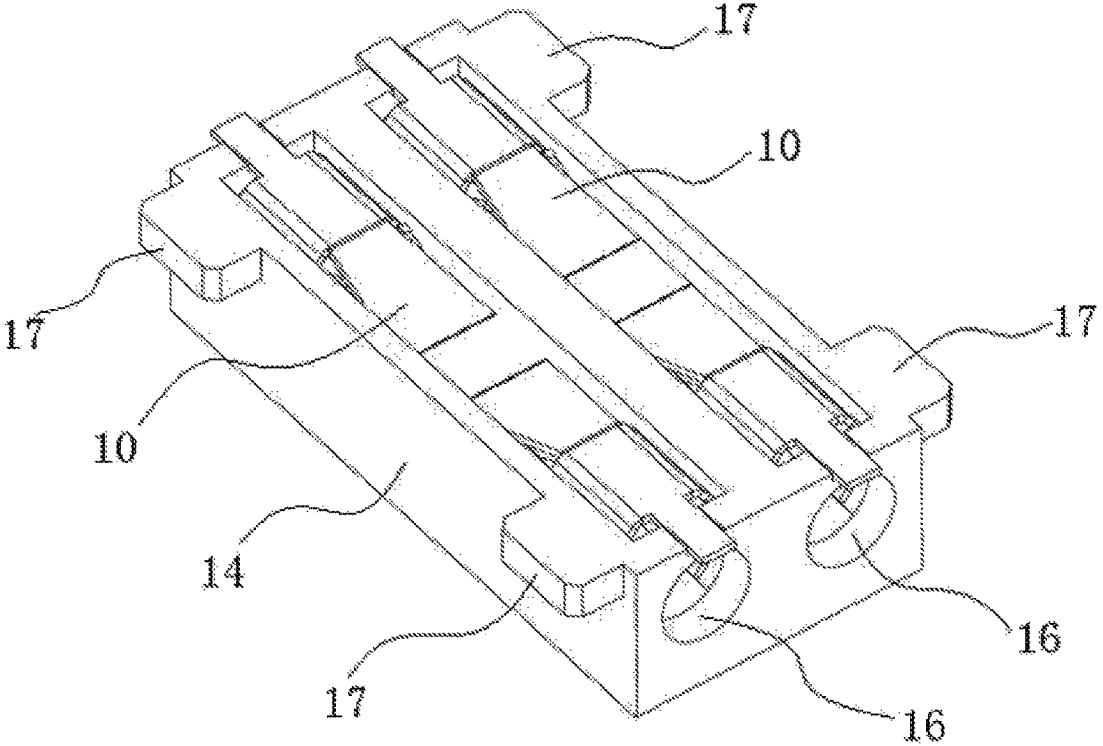
FIG. 2 is the structural schematic view of the bottom of the surface-mounted pluggable wiring insert key according to the present invention.
Figure 3:
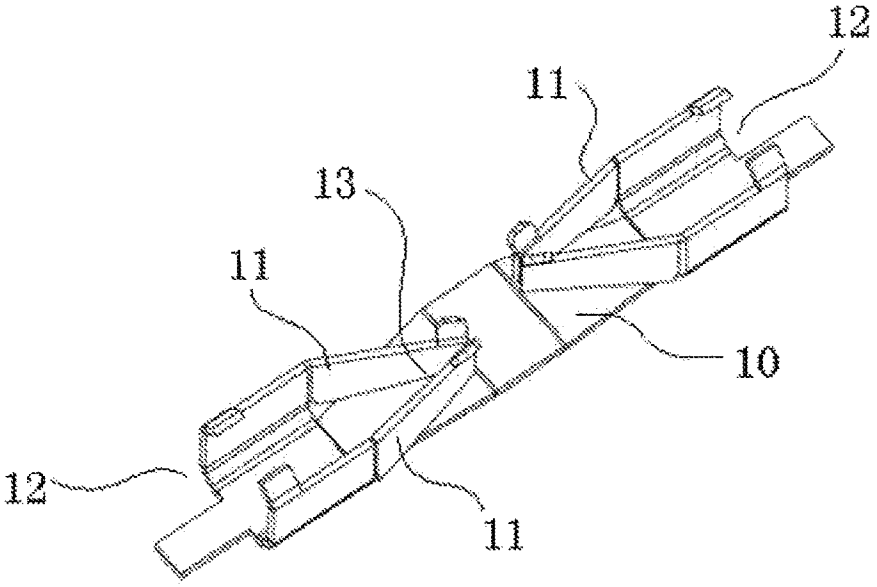
FIG. 3 is the structural schematic view of the key body of the surface-mounted pluggable wiring insert key according to the present invention.
Figure 4:
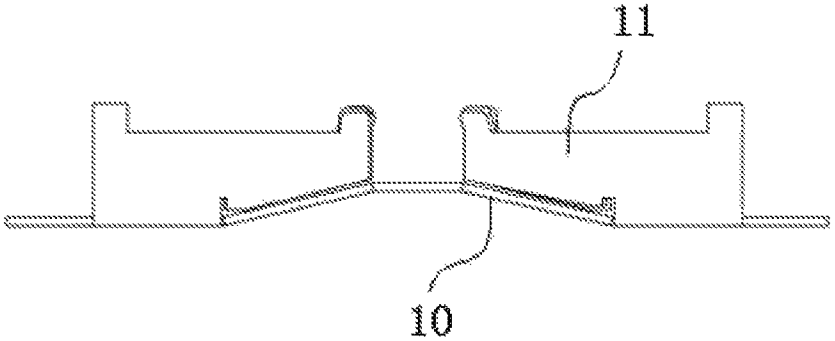
FIG. 4 is the front structural schematic view of FIG. 3.

1. ventilation hole; 2. light head; 3. heat-dissipating light housing; 4. LED light cover; 5. LED light source; 6. power supply bracket mounting plate; 61. ledge; 62. groove rail; 7. power supply cover; 71. linear groove; 8. driving power supply; 9. surface-mounted pluggable wiring insert key; 10. insert plate; 11. elastic insert piece; 12. wiring slot; 13. wire clamp; 14. insert key box; 15. press key; 16. wiring hole; 17. connecting part; 18. inner wall of upper portion of heat dissipating light housing.

DETAILED DESCRIPTION OF THE EMBODIMENT

As shown in FIGS. 1-4, the surface-mounted pluggable wiring insert key of the present invention comprises insert key box 14, and positive and negative pole insert key bodies that are mounted in insert key box 14. Each of the positive and negative pole insert key bodies comprises insert plates 10. Each end of each insert plate 10 is provided with elastic insert pieces 11. Two elastic insert pieces 11 on each side of insert plate 10 are curled inwardly such that one end of each of two elastic insert pieces 11 form a wire clamp 13, and the other end of each of two elastic insert pieces 11 form wiring slot 12. Two ends of the insert key box are provided with wiring hole 16 corresponding to the position of wiring slot 12. The upper portion of insert key box 14 is provided with press key 15, which is right above wire clamp 13. When press key 15 is pressed, wire clamp 13 opens to guide the connecting wire into wire clamp 13. The release of press key 15 then completes the connection. The positive and negative pole insert key bodies and the elastic insert piece are conductors, while the insert key box is an insulator. In the positive and negative pole insert key bodies, two wire clamps 13 formed on two ends of insert plate 10 are positioned oppositely. In the positive and negative pole insert key bodies, the center part of insert plate 10 projects upwardly to get close to wire clamp 13 such that the connecting wire can be better connected to wire clamp 13 during the connecting process.

Figure 5:
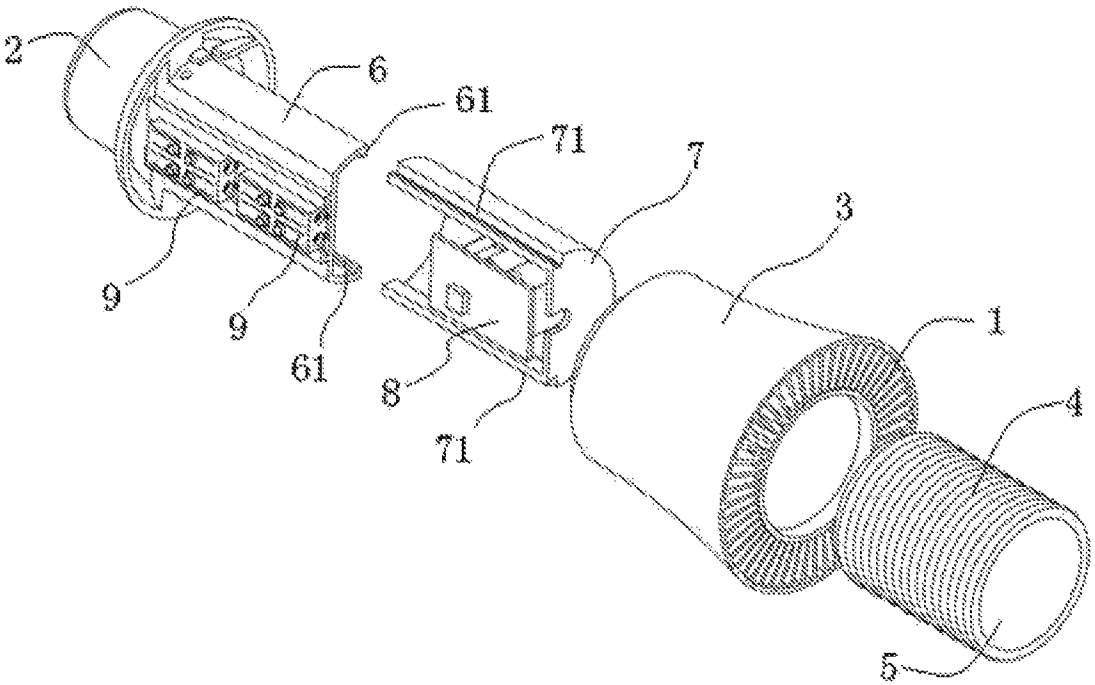
FIG. 5 is the exploded structural schematic view of the detachable modular LED light according to the present invention.
Figure 6:
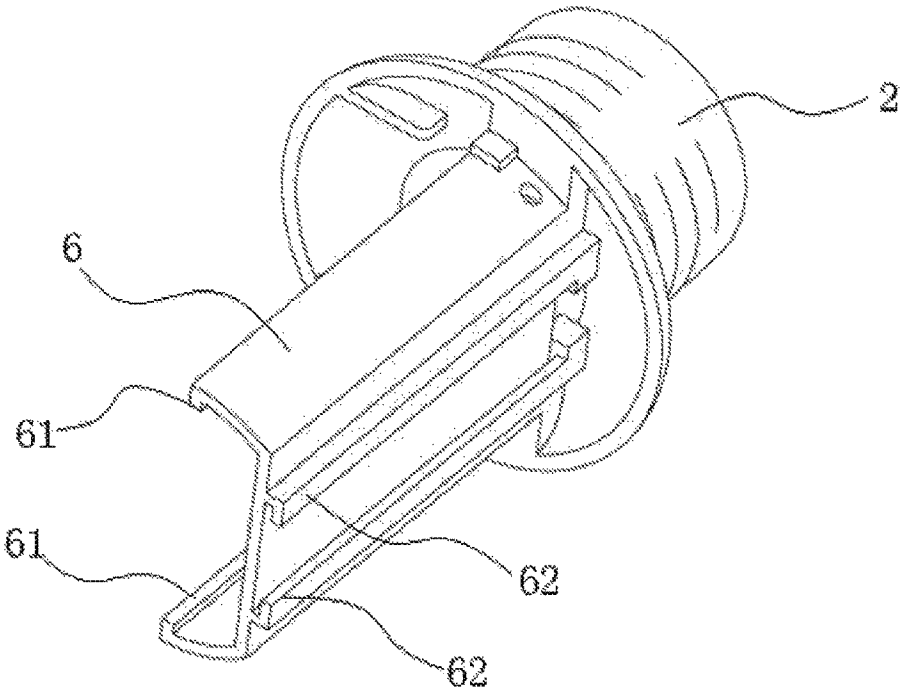
FIG. 6 is the partial structural schematic view of the LED driving power supply box according to the present invention.
Figure 7:
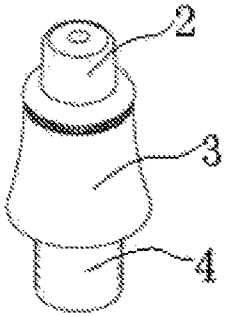
FIG. 7 is the structural schematic view of the general assembly of the detachable modular LED light according to the present invention.
Figure 8:
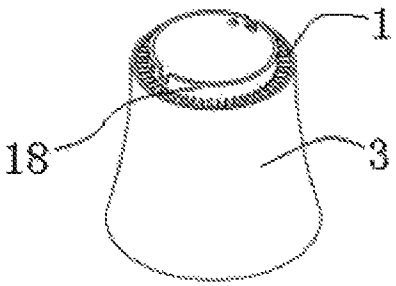
FIG. 8 is the schematic view of the heat dissipating light cover in FIG. 5.

As shown in FIGS. 5-6, the LED driving power supply box formed by above surface-mounted pluggable wiring insert key 9 of the present invention comprises light head 2. Power supply bracket mounting plate 6 is provided on light head 2. Two surface-mounted pluggable wiring insert keys 9 are provided on the upper surface of power supply bracket mounting plate 6. Power supply cover 7 is connected to power supply bracket mounting plate 6 and located below power supply bracket mounting plate 6. Space for accommodating driving power supply 8 is formed between power supply bracket mounting plate 6 and power supply cover 7. Power supply bracket mounting plate 6 is provided with a threaded hole. The positive and negative pole leading lines of driving power supply 8 can pass through the threaded hole to connect to surface-mounted pluggable wiring insert key 9 and in turn connect to the positive and negative poles of light head 2 and to the positive and negative poles of the LED light source. Groove rail 62 is provided on the upper surface of power supply bracket mounting plate 6. Connecting part 17 that fits groove rail 62 in terms of size and shape is provided on insert key box 14 of surface-mounted pluggable wiring insert key 9 such that surface-mounted pluggable wiring insert key 9 can be movably mounted on the upper surface of power supply bracket mounting plate 6. The end portion of each side of power supply bracket mounting plate 6 is provided with ledge 61. Each side portion of power supply cover 7 is provided with linear groove 71 that fits ledge 61 in terms of size and shape such that power supply cover 7 can be movably mounted on power supply bracket mounting plate 6. Ventilation holes (not shown) are provided on power supply cover 7.

As shown in FIGS. 5-8, a detachable modular LED light comprising the driving power supply box comprises LED light source 5, driving power supply 8, and heat-dissipating light housing 3. The detachable modular LED light further comprises above LED driving power supply box. The LED driving power supply box can be installed in heat dissipating light housing 3 and heat dissipating light housing 3 is detachably connected to the LED driving power supply box. The LED driving power supply box can be connected to the heat dissipating light housing through a threaded connection, a snap-fit connection, an elastic-pin connection, or other connecting manners to achieve the detachable connection between LED driving power supply box and the heat dissipating light housing. Heat dissipating light housing 3 has an overall shape necking down from top to bottom. Several ventilation holes 1 are positioned between the inner wall and outer wall of heat dissipating light housing 3 from top to bottom. The inner wall of the upper part of heat dissipating light housing 3 is higher than the outer wall of the upper part of heat dissipating light housing 3. LED light source 5 is located in LED light cover 4. LED light cover 4 is detachably connected to the lower end of heat dissipating light housing 3. The LED light cover can be connected to the heat dissipating light housing through a threaded connection, a snap-fit connection, an elastic-pin connection, or other connecting manners to achieve the detachable connection.

The present invention can realize the convenient replacement of damaged driving power supply and the related parts without causing the abandonment of the LED chip with long lifespan or even the whole LED light, thereby saving resources, reducing the use cost and production cost. Moreover, the popularity of LED lights is facilitated. The driving power supply box of the present invention can be applied in combination with patents CN201210143808.6 (an LED light), CN201210361467.X (grouped and detachable LED light), and CN201210191775.2 (an LED bead) such that LED light bead or driving power supply or other related parts in one light can be replaced as needed. As a result, compared with the conventional integrally welded light, the present invention improves the quality of the light and significantly lowers the use cost of the LED such that the LED light can be popularized faster and better.

What is claimed is:

1. A surface-mounted pluggable wiring insert key, comprising:

an insert key box, and a positive pole insert key body and a negative pole insert key body mounted in the insert key box;

wherein each of the positive pole insert key body and the negative pole insert key body comprises an insert plate;

each of two ends of each insert plate is provided with two elastic insert pieces;

two elastic insert pieces on each end of each the insert plates are curled inwardly such that one end of each of the two elastic insert pieces form a wire clamp and the other end of each of the two elastic insert pieces form a wiring slot;

each end of the insert key box is provided with a wiring hole corresponding to a position of the wiring slot;

an upper part of the insert key box is provided with a press key; and the press key is located right above the wire clamp.

2. The surface-mounted pluggable wiring insert key of claim 1, wherein in the positive pole insert key body and the negative pole insert key body, two wire clamps formed on two ends of the insert plate are positioned oppositely.

3. The surface-mounted pluggable wiring insert key of claim 1, wherein in the positive pole insert key body and the negative pole insert key body, a center part of the insert plate protrudes upwardly to be close to the wire clamp.

4. An LED driving power supply box, comprising a light head, wherein the light head is provided with a power supply bracket mounting plate;

an upper surface of the power supply bracket mounting plate is provided with at least two surface-mounted pluggable wiring insert keys, wherein each of the at least two surface-mounted pluggable wiring insert keys comprises:

an insert key box, and a positive pole insert key body and a negative pole insert key body mounted in the insert key box;

wherein each of the positive pole insert key body and the negative pole insert key body comprises an insert plate;

each of two ends of each insert plate is provided with two elastic insert pieces;

two elastic insert pieces on each end of each the insert plates are curled inwardly such that one end of each of the two elastic insert pieces form a wire clamp and the other end of each of the two elastic insert pieces form a wiring slot;

each end of the insert key box is provided with a wiring hole corresponding to a position of the wiring slot;

an upper part of the insert key box is provided with a press key; and the press key is located right above the wire clamp;

a power supply cover is located below and connected to the power supply bracket mounting plate;

a space for accommodating a driving power supply is formed between the power supply bracket mounting plate and the power supply cover;

the power supply bracket mounting plate is provided with a threaded hole; and a positive pole leading wire and a negative pole leading wire of the driving power supply pass through the threaded hole and connect to the surface-mounted pluggable wiring insert key.

5. The LED driving power supply box of claim 4, wherein the upper surface of the power supply bracket mounting plate is provided with a groove rail; and an insert key box of the surface-mounted pluggable wiring insert key is provided with a connecting part fitting the groove rail such that the surface-mounted pluggable wiring insert key is movably mounted on the upper surface of the power supply bracket mounting plate.

6. The LED driving power supply box of claim 4, wherein an end portion of each side of the power supply bracket mounting plate is provided with a ledge; and each side portion of the power supply cover is provided with a linear groove fitting the ledge such that the power supply cover is movably mounted on the power supply bracket mounting plate.

7. The LED driving power supply box of claim 4, wherein the power supply cover is provided with a ventilation hole.

8. The surface-mounted pluggable wiring insert key of claim 4, wherein in the positive pole insert key body and the negative pole insert key body, two wire clamps formed on two ends of the insert plate are positioned oppositely.

9. The surface-mounted pluggable wiring insert key of claim 4, wherein in the positive pole insert key body and the negative pole insert key body, a center part of the insert plate protrudes upwardly to be close to the wire clamp.

10. A detachable modular LED light, comprising a LED light source, a driving power supply, and a heat-dissipating light housing, wherein the detachable modular LED light further comprises a LED driving power supply box, wherein the LED driving power supply box comprises:

a light head, wherein the light head is provided with a power supply bracket mounting plate; an upper surface of the power supply bracket mounting plate is provided with at least two surface-mounted pluggable wiring insert keys, wherein each of the at least two surface-mounted pluggable wiring insert keys comprises:

an insert key box, and a positive pole insert key body and a negative pole insert key body mounted in the insert key box;

wherein each of the positive pole insert key body and the negative pole insert key body comprises an insert plate;

each of two ends of each insert plate is provided with two elastic insert pieces;

two elastic insert pieces on each end of each the insert plates are curled inwardly such that one end of each of the two elastic insert pieces form a wire clamp and the other end of each of the two elastic insert pieces form a wiring slot;

each end of the insert key box is provided with a wiring hole corresponding to a position of the wiring slot;

an upper part of the insert key box is provided with a press key; and the press key is located right above the wire clamp;

a power supply cover is located below and connected to the power supply bracket mounting plate;

a space for accommodating a driving power supply is formed between the power supply bracket mounting plate and the power supply cover;

the power supply bracket mounting plate is provided with a threaded hole; and a positive pole leading wire and a negative pole leading wire of the driving power supply pass through the threaded hole and connect to the surface-mounted pluggable wiring insert key;

the LED driving power supply box can be mounted in the heat dissipating light housing; and the heat dissipating light housing is detachably connected to the LED driving power supply box.

11. The detachable modular LED light of claim 10, wherein the heat-dissipating light housing has an overall shape that is necked down from top to bottom;

several ventilation holes are positioned from top to bottom between an inner wall and an outer wall of the heat-dissipating light housing; and the inner wall is higher than the outer wall at an upper end of the heat-dissipating light housing.

12. The detachable modular LED light of claim 10, wherein the LED light source is located in a cylindrical light cover; and the cylindrical light cover is detachably connected to a lower end of the heat-dissipating light housing.

13. The LED driving power supply box of claim 10, wherein the upper surface of the power supply bracket mounting plate is provided with a groove rail; and an insert key box of the surface-mounted pluggable wiring insert key is provided with a connecting part fitting the groove rail such that the surface-mounted pluggable wiring insert key is movably mounted on the upper surface of the power supply bracket mounting plate.

14. The LED driving power supply box of claim 10, wherein an end portion of each side of the power supply bracket mounting plate is provided with a ledge; and each side portion of the power supply cover is provided with a linear groove fitting the ledge such that the power supply cover is movably mounted on the power supply bracket mounting plate.

15. The LED driving power supply box of claim 10, wherein the power supply cover is provided with a ventilation hole.

* * * * *